United States Patent [19]

Honda

[11] Patent Number: 4,834,124

[45] Date of Patent: May 30, 1989

[54] ULTRASONIC CLEANING DEVICE

[75] Inventor: Keisuke Honda, Aichi, Japan

[73] Assignee: Honda Electronics Co., Ltd., Aichi, Japan

[21] Appl. No.: 2,308

[22] Filed: Jan. 9, 1987

[51] Int. Cl.[4] ..... B08B 3/02

[52] U.S. Cl. ..... 134/184; 134/1; 134/144; 134/148; 134/198; 239/102.2; 310/325; 366/127

[58] Field of Search ..... 134/1, 144, 148, 153, 134/184, 198; 68/355; 366/127; 239/4, 102.2; 310/325; 74/155

[56] References Cited

U.S. PATENT DOCUMENTS

| | | | |
|---|---|---|---|
| 3,067,948 | 12/1962 | Lang et al. | 239/102.2 X |
| 3,103,310 | 9/1963 | Lang | 239/102.2 X |
| 3,427,280 | 2/1969 | Robinson | 310/325 |
| 3,561,459 | 2/1971 | Ciongwa et al. | 134/144 |

FOREIGN PATENT DOCUMENTS

| | | | |
|---|---|---|---|
| 973458 | 10/1964 | United Kingdom | 239/102.2 |
| 1277104 | 6/1972 | United Kingdom | 134/153 |

*Primary Examiner*—Philip R. Coe

*Attorney, Agent, or Firm*—Burgess, Ryan and Wayne

[57] ABSTRACT

An ultrasonic cleaning device comprises an ultrasonic pump having a hollow cover forming a spouting port in a narrow portion thereof, an ultrasonic vibrator in a wide portion thereof and a liquid supply port in a side portion thereof. An oscillator is connected to the ultrasonic vibrator. One part of the ultrasonic wave from the vibrator is passed through the spouting portion straight and the other part of the ultrasonic wave is reflected on the inside of the cover and is passed through the spouting port. An object or objects are opposed to the spouting port of the cover.

3 Claims, 7 Drawing Sheets

ULTRASONIC CLEANING DEVICE

BACKGROUND OF THE INVENTION

The present invention relates to an ultrasonic cleaning device for cleaning an object or objects by ultrasonic waves and liquid.

In a general ultrasonic cleaning device, an ultrasonic vibrator is provided in the base of a cleaning container and a conveyer is moved in the cleaning container. An object or objects put on the conveyer are moved in the cleaning liquid in the cleaning container and are made clean.

In this ultrasonic cleaning device, however, the object or objects are soaked in the cleaning liquid during cleaning. Therefore, objects become dirty when they are taken out of the cleaning liquid in the cleaning container, because the dirt removed from the object or objects during cleaning floats on the cleaning liquid in the container.

Also, there is an ultrasonic cleaning device in which an ultrasonic vibrator is mounted in the wide end of a hollow cover having an exponential cross section, a flowing port is formed in the narrow end of the cover, and a liquid supply port is provided in the side wall of the cover.

In this ultrasonic cleaning device, one part of the ultrasonic wave generated from the ultrasonic vibrator is passed straight through the flow port, but the other part of the ultrasonic wave is reflected on the inside wall of the cover two times or more. Therefore, since the reflected ultrasonic wave interferes with the ultrasonic wave from the ultrasonic vibrator, the cleaning liquid is not produced from the flow port and the object or objects can not be clean.

In an ultrasonic cleaning device having a cover of a frustum of cone in the prior art, one part of the ultrasonic wave produced from the ultrasonic vibrator which is mounted in the wide portion of the cover is passed straight through the flow port, but the other part of the ultrasonic wave is reflected on the inside wall of the cover two times or more. Therefore, since the reflected ultrasonic wave interferes with the ultrasonic wave from the ultrasonic vibrator, the cleaning liquid is not produced from the flow port and the object or objects can not be cleaned.

SUMMARY OF THE INVENTION

It is, therefore, a primary object of the present invention to provide an ultrasonic cleaning device in which an object or objects are not soaked with a cleaning liquid.

It is another object of the present invention to provide an ultrasonic cleaning device in which an object or objects can be made clean by liquid with ultrasonic wave spouted from a spouting port.

It is still another object of the present invention to provide an ultrasonic cleaning device in which cleaning liquid is intermittently generated with ultrasonic waves from a spouting port.

In order to accomplish the above and other object, the present invention comprises an ultrasonic pump having a hollow cover forming a spouting port in a narrow portion thereof, an ultrasonic vibrator in a wide portion thereof, a liquid supply port in a side portion thereof, and an oscillator connected to the ultrasonic vibrator, one part of the ultrasonic wave from the vibrator being straight passed through the spouting port and the other part of the ultrasonic wave being reflected on the inside of the cover and being passed through the spouting portion, and an object or objects opposed to the spouting port of the cover.

These and other object, feature and advantages of the invention will become more apparent from the following description taken in connection with the illustrated embodiment of the accompanying drawings. Brief Description of the Drawings FIG. 1 illustrates a constitution of the cleaning device in the prior art.

DESCRIPTION OF THE PREFERRED EMBODIMENTS

Figure 1:
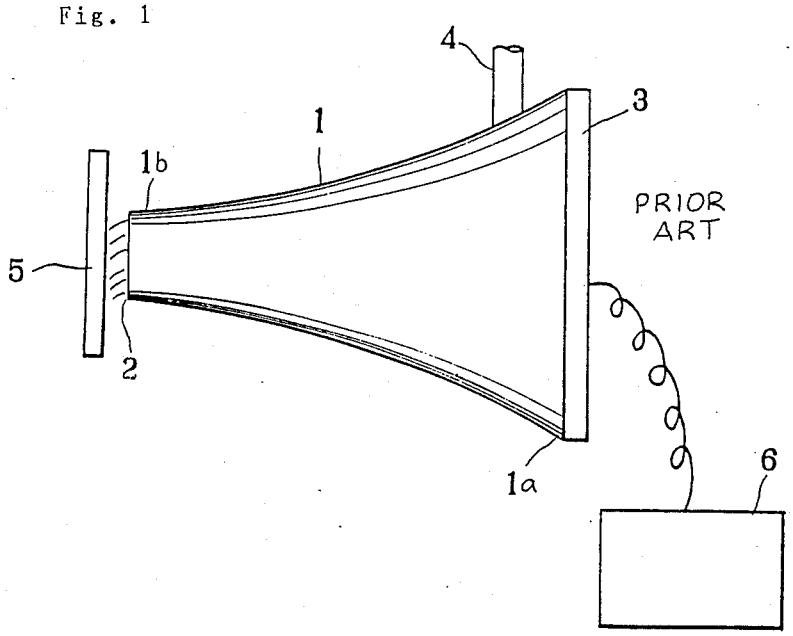

There is an ultrasonic cleaning device shown in FIG. 1 in a prior art. In this ultrasonic cleaning device, an ultrasonic pump has a hollow cover 1 having an exponential cross section in which an ultrasonic vibrator 3 is mounted in its wide end 1*a*, a spouting port 2 is formed in its narrow end 1*b*, and a supply port 4 is provided in its side wall. An object 5 is opposed to the spouting port 1*b* of the cover 1. An oscillator supplies the power of adequate frequency to the ultrasonic vibrator 3.

Figure 2:
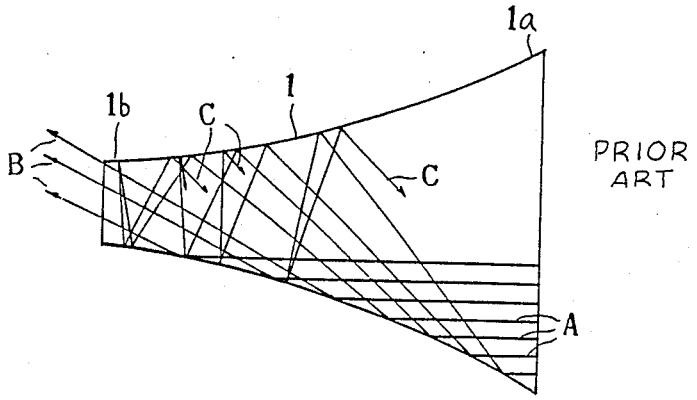
FIG. 2 illustrates a principle of the prior art for generating ultrasonic waves and cleaning liquid.

In the ultrasonic cleaning device in the prior art, when the ultrasonic wave is generated from the ultrasonic vibrator 3 as shown by the arrow A of FIG. 2, one part of the ultrasonic wave is passed straight through the flowing port 2, but the other part of the ultrasonic wave is reflected by the inside wall of the cover. One part B of the reflected ultrasonic wave is taken out from the flowing port 2 of the cover, but the other part C of the ultrasonic wave is again reflected by the inside wall of the cover 1 and is advanced to the ultrasonic vibrator 3. Therefore, the ultrasonic wave reflected twice or more on the inside wall interferes with the ultrasonic wave from the ultrasonic vibrator 3. Thereby, the liquid and the ultrasonic wave are not spouted from the flowing port and the object 5 can not be cleaned.

Figure 3:
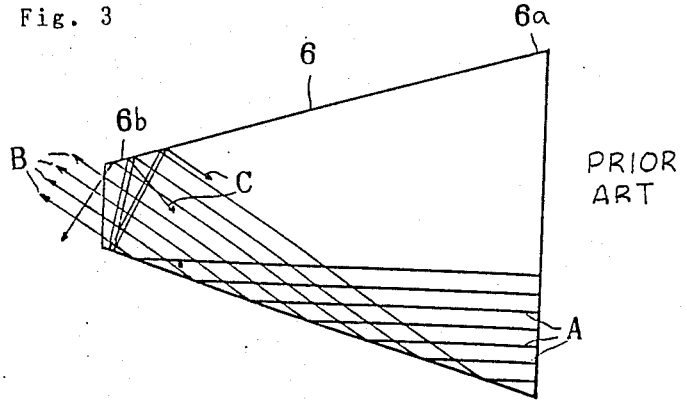
FIG. 3 illustrates a principle of other prior art for generating ultrasonic waves and cleaning liquid.

In the ultrasonic cleaning device having a cover 6 having a frustum of cone as shown n FIG. 3, the ultrasonic wave is generated from the ultrasonic vibrator 3 which is mounted in the wide portion 6*a* of the cover 6 and one part A of the ultrasonic wave is passed straight through the spouting port 2, but the other part A of the ultrasonic wave is reflected on the inside wall of the cover 6. One part B of the reflected ultrasonic wave is taken out from the spouting port 2, but the other part C of the reflected ultrasonic wave is again reflected by the inside wall of the cover 1 and is advanced to the ultrasonic vibrator 3. Therefore, since the reflected ultrasonic wave interferes with the ultrasonic wave from the ultrasonic vibrator, the cleaning liquid is not produced from the spouting port 2 and the object or objects can not be cleaned.

Figure 4:
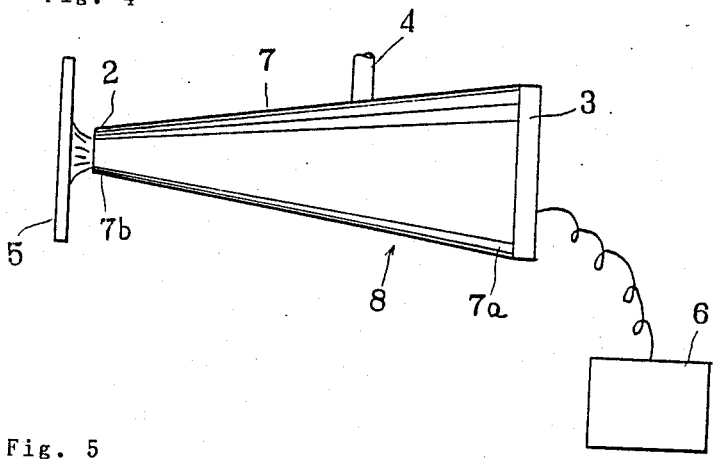
FIG. 4 illustrates a constitution of the ultrasonic cleaning device according to the present invention.

Referring to FIG. 4, the ultrasonic cleaning device according to the present invention has an ultrasonic pump 8, in which a conic cover 7 of a frustum of cone is hollow, an ultrasonic vibrator 3 is mounted in the wide portion 7a of the cover 7, a spouting port 2 is formed in the narrow portion 7b of the cover 7, a liquid supply port 4 is mounted on the side wall of the cover 7. An object 5 to be cleaned is opposed to the spouting port 7b. An oscillator supplies an output having adequate frequency.

Figure 5:
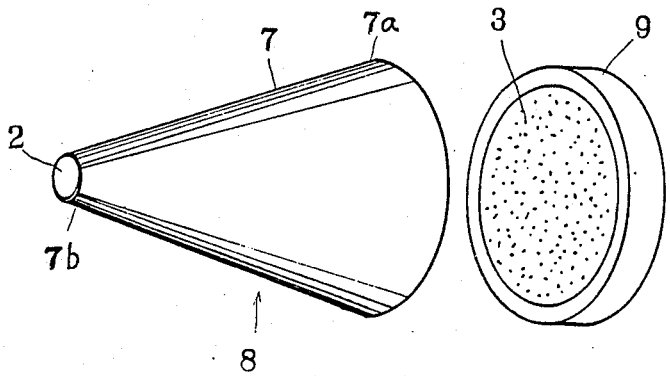
FIG. 5 is a blown apart perspective view of an ultrasonic pump according to the present invention.

As shown in FIG. 5, the ultrasonic vibrator 3 is provided with an elastic material as a sponge in a case 9 and one portion of the case 9 is opened to effectively transmit an ultrasonic wave from the ultrasonic vibrator to the inside of the cover 7 and the ultrasonic vibrator 3 is exposed to the cleaning liquid.

Figure 6:
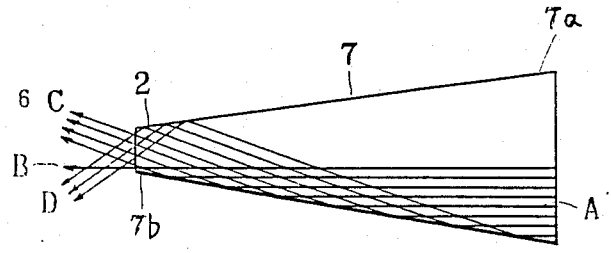
FIG. 6 illustrates a principle of the ultrasonic cleaning device in FIG. 4.

In the ultrasonic cleaning device according to the present invention, as shown in FIG. 6, when the ultrasonic wave A is advanced to the spouting port 2, one part B of the ultrasonic wave A is passed through the spouting port 2, the second part C is reflected on the under inside portion of the cover 7 and is passed through the spouting port 2 and the third part D is reflected on the upper inside portion of the cover and is passed through the spouting port 2.

Therefore, since the ultrasonic wave from the ultrasonic vibrator 3 is not interfered with the reflected ultrasonic wave, when the liquid is supplied from the supply port 4, the liquid is spouted from the spouted port 7b with the ultrasonic wave. Thus, this device functions as an ultrasonic pump. When the ultrasonic wave and the liquid spouted from the ultrasonic pump 8 are sprinkled over the object 5, the dirt of the object 5 is effectively removed. Since the object 5 is not contained in the container and the liquid is sprinkled over only the surface of the object 5, the drying of the object 5 is very easy.

Figure 7:
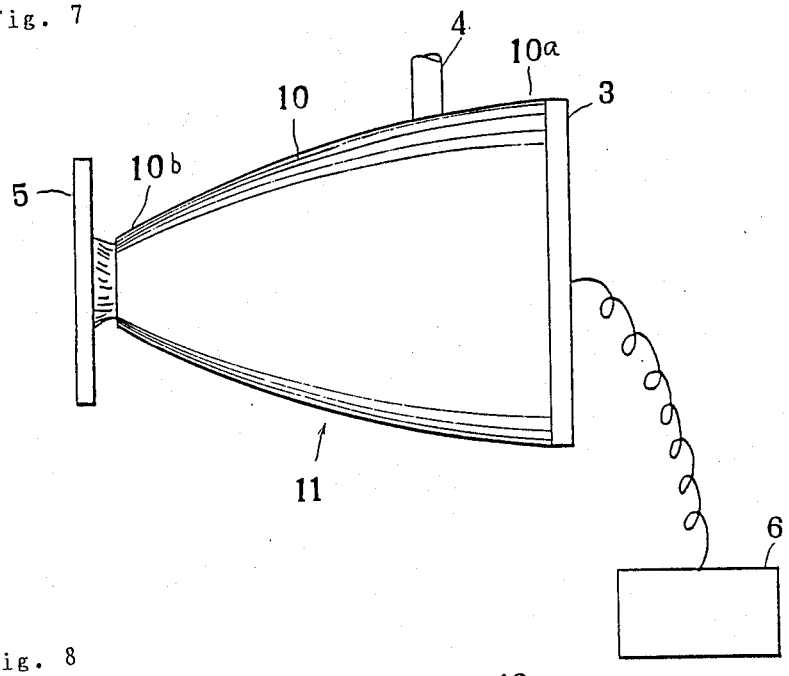
FIG. 7 illustrates another constitution of the ultrasonic cleaning device according to present invention.

Referring to FIG. 7, in another ultrasonic cleaning device according to the present invention, the pump 8 has a hollow cover 10 of a parabolic cross section. The cover 10 has a spouting port 2 in the narrow portion 10b, the ultrasonic vibrator 3 in the wide portion 10a and the liquid supply port 4 in the side of the cover 10. The oscillator 6 supplies the power of an adequate frequency to the ultrasonic vibrator 3. An object 5 is opposed to the spouting port 2.

Figure 8:
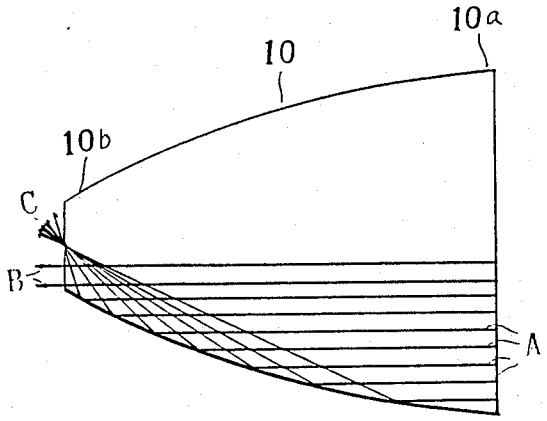
FIG. 8 illustrates a principle of the ultrasonic cleaning device in FIG. 7.

In the ultrasonic cleaning device according to the present invention, as shown in FIG. 8, when the ultrasonic wave A from the ultrasonic vibrator 3 is advanced toward the spouting port 2, the ultrasonic wave A is divided into one part B passed straight through spouting port 2 and the other part C collected to the center of the spouting port 2.

Therefore, since the ultrasonic wave from the ultrasonic vibrator 3 is not interfered with the reflected ultrasonic wave, when the liquid 12 is supplied from the supply port 4, the liquid is spouted from the spouting port 7b with the ultrasonic wave. Thus, this device functions as an ultrasonic pump. When the ultrasonic wave and the liquid spouted from the ultrasonic pump 11 are sprinkled over the object 5, the dirt of the object 5 is effectively removed. Since the object 5 is not contained in the container and the liquid is sprinkled over only the surface of the object 5, the drying of the object 5 is very easy.

The ultrasonic cleaning device of the present invention can use any covers in which the coherent ultrasonic wave generated from the ultrasonic vibrator is reflected on its inside wall and the reflected ultrasonic wave is not interfered with the ultrasonic wave from the ultrasonic vibrator.

Figure 9:
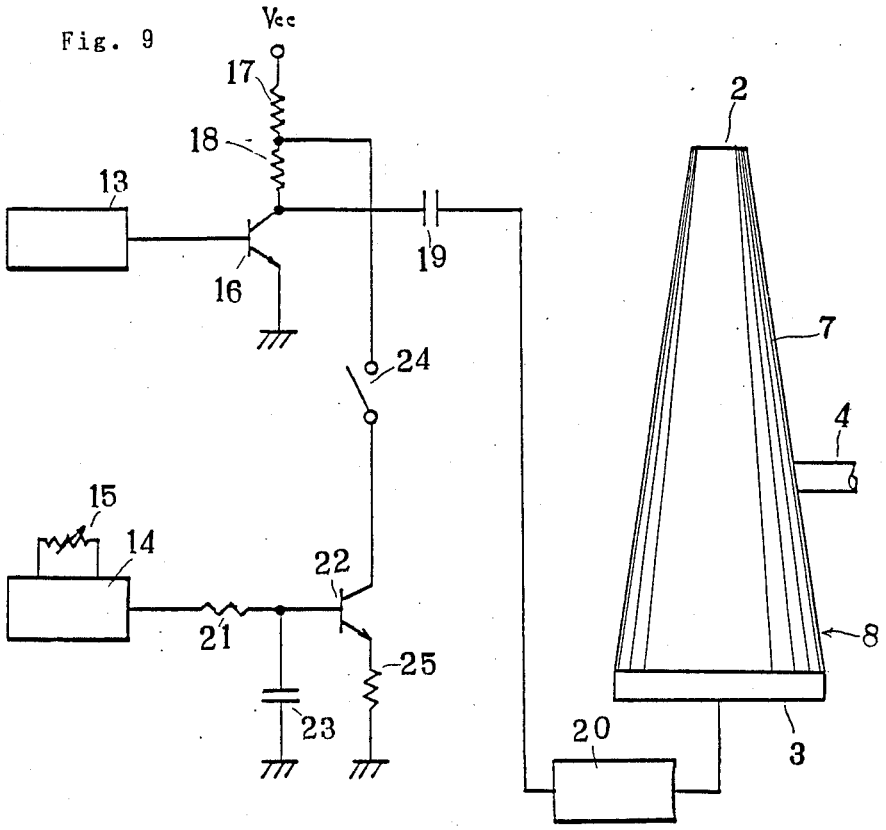
FIG. 9 illustrates a further constitution of the ultrasonic cleaning device according to present invention.
Figure 10:
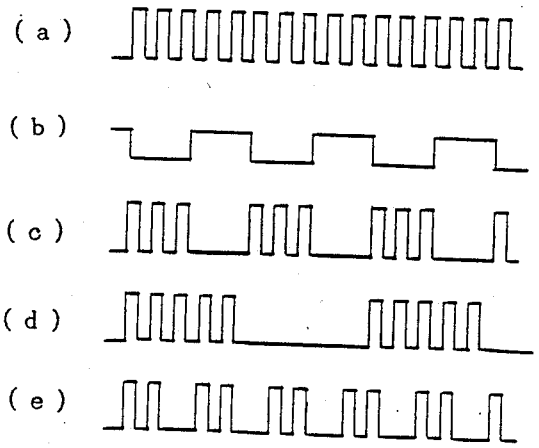
FIG. 10 illustrates the output waves of oscillators and the output of ultrasonic waves from the spouting port in FIG. 9.

Referring to FIG. 9, in another ultrasonic cleaning device according to the present invention the pump 8 has the cover 7, the spouting port 2 in the narrow port, the ultrasonic vibrator 3 in the wide port and the liquid supply port 4 in the side of the cover 7 and is substantially similar in physical constitution to the embodiment shown in FIG. 4 except for the oscillator 6. The oscillator 6 in this embodiment has a first oscillator 13 from which pulses repeated in a constant short cycle are generated as shown in FIG. 10(*a*) and a second oscillator 14 in which pulses repeated in a constant long cycle is generated and the cycle is changed by a potentiometer 15 as shown in FIG. 10(*b*). The first oscillator 13 is connected to the base of the transistor 16, its emitter to the ground and its collector is connected to a power supply Vcc through resistors 17 and 18. The connected point between the resistors 17 and 18 is connected to the ultrasonic vibrator 3 through a condenser 19 and an output circuit 20. The second oscillator 14 is connected to the base of the transistor 22 through a resistor 21, the base is connected to the ground through a condenser 23. The collector of the transistor 22 is connected to the connected point between the resistors 17 and 18 through a switch 24 and the emitter of the transistor 22 is connected through a resistor 25 to the ground. Also, the resistor 21 and condenser 23, which are connected to the second oscillator 14, constructs an integrator for deforming the output wave form of the second oscillator 14 and the for protecting the transistor 22.

In the ultrasonic cleaning device of the present invention using the ultrasonic pump, when the first oscillator 13 is oscillated, the transistor 16 repeats on and off operation by the pulse output from the first oscillator 13 and the output corresponding to the output of the first oscillator 13 is supplied from the output circuit 20 to ultrasonic vibrator 3 as shown in FIG. 10(*a*). Then, when the second oscillator 14 is driven and the switch 24 is closed, an intermittent wave is generated from the second oscillator 14 as shown in FIG. 10(*b*) and is supplied to the base of the transistor 22. Therefore, because the transistor 22 is conducted during the supply of the intermittent wave and the current from the power supply Vcc is supplied through switch 24 to the resistor 25 during the conduction of the transistor 22 and is supplied to transistor 16 during no conduction of the transistor 22, the output of the output circuit 20 is intermittently supplied to the ultrasonic vibrator 3 as shown in FIG. 10(*c*). Also, when the potentionmeter 15 of the second oscillator 14 is changed, the cycles for generating the intermittent waves are changed as shown in FIGS. 10(*d*) and 10(*e*). Thereby any cycle to be obtained with a high cleaning effect is selected by the potentionmeter 15.

As stated above, in the ultrasonic cleaning device having the ultrasonic pump according to the present invention, the cleaning effect is more improved because an instantaneous power is applied to the object, when the intermittent ultrasonic waves are generated from the ultrasonic vibrator. Moreover, the cleaning effect is improved by the pulses of the constant cycle from the first oscillator 13 and the changeable intermittent wave from the second oscillator 14 and by the liquid spouted from the narrow spouting port 2 of the cover 7 with the ultrasonic wave.

Figure 11:
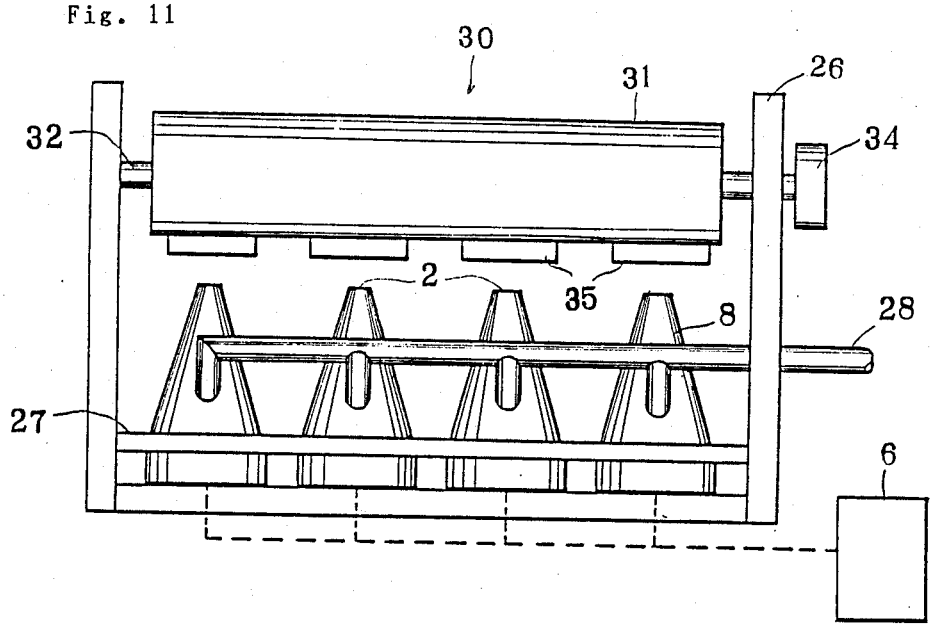
FIG. 11 is a front view of a still further ultrasonic cleaning device according to the present invention.
Figure 12:
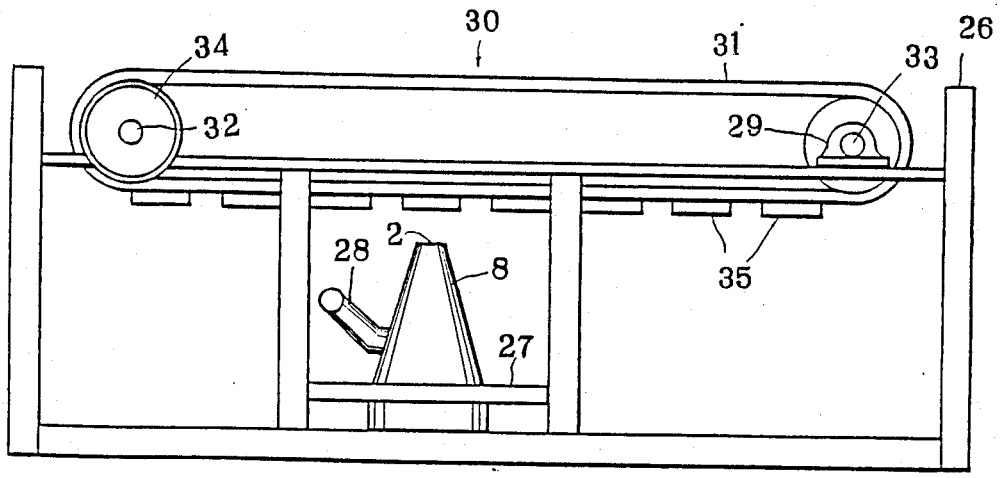
FIG. 12 is a side view of the ultrasonic cleaning device in FIG. 11.

Referring to FIGS. 11 and 12, an ultrasonic cleaning device having a plurality of ultrasonic pumps is shown. The ultrasonic pumps 8 are supported by a supporting structure 27 of a frame structure 26 to direct the spouting ports 2 upward. The output from the oscillator 6 is respectively applied to the ultrasonic vibrators 3 of the ultrasonic pumps 8. The liquid supply ports 4 of the ultrasonic pumps 8 are connected to a pipe 28 connected to a tank(not shown). Rotary shafts 32 and 33 of rollers are supported by bearings 29 on the upper portion of the frame structure 26. Also, a belt 31 of the belt conveyer 30 is moved by the rollers and a pulley 34 for rotating the rotary shaft 32 is connected through a belt to a motor and so on. The objects 35 to make clean are supported on the belt 31 of the belt conveyor 30 and are moved in the upper portion of the spouting port 2 of the ultrasonic pump 8.

In the ultrasonic cleaning device of the present invention, when the belt convayer 30 is driven and the objects 35 are passed in the upper portion of the ultrasonic pumps 8, the ultrasonic wave and liquid are spouted toward the objects 35 from the spouting port 2 of the ultrasonic pump 8 and the objects 35 are cleaned by the ultrasonic wave and the liquid. The liquid made dirty by cleaning the objects 35 is not contained in the ultrasonic pump 8 and falls in a container(not shown). Therefore, the objects are not soaked in the cleaning liquid and are not made dirty.

Figure 13:
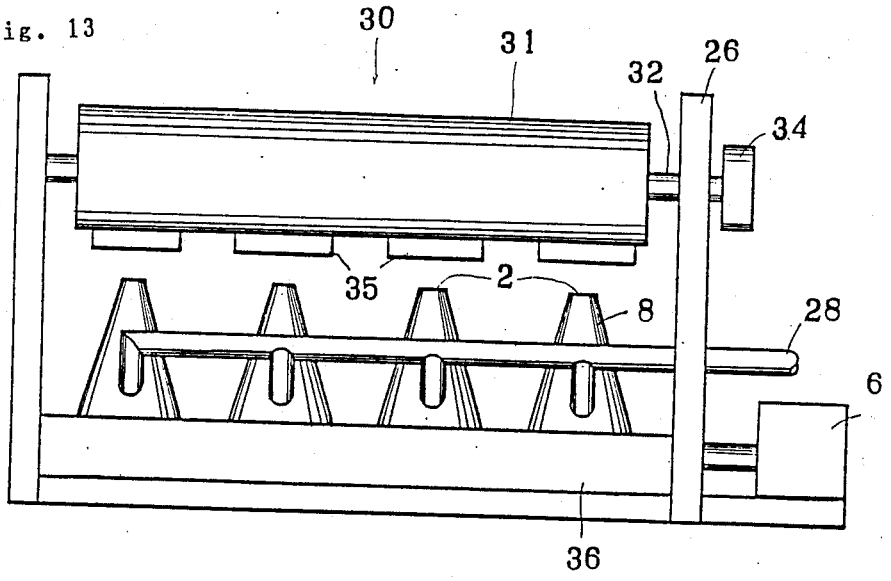
FIG. 13 is a front view of a yet further ultrasonic cleaning device according to the present invention.
Figure 14:
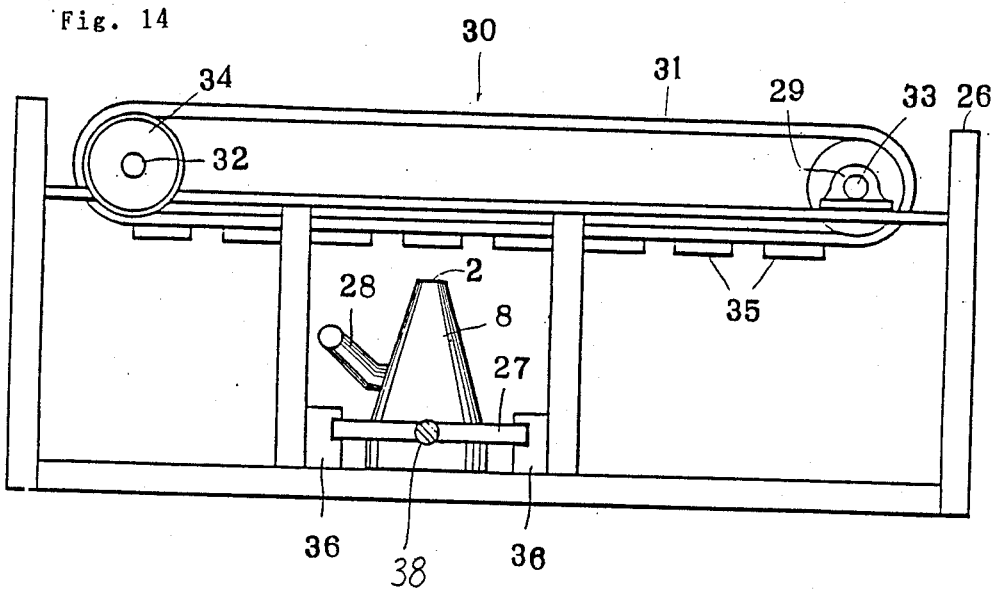
FIG. 14 is a side view of the ultrasonic cleaning device of FIG. 13.

Referring to FIGS. 13 and 14, another ultrasonic cleaning device according to the present invention is substantially similar in physical construction to the device shown in FIGS. 11 and 12 except that the supporting structure 27 for supporting a plurality of ultrasonic pumps is mounted on the lower portion of the frame structure 26 by a sliding structure 36 to move toward a right angle to the moving direction of the belt 31 of the belt conveyor 30. The supporting structure 27 is connected to a reciprocating device through a drive shaft 38.

In the ultrasonic cleaning device of the present invention, since the ultrasonic pump is moved at a right angle to the moving direction of the belt 31 of the belt conveyor 30 and the liquid and the ultrasonic wave from the ultrasonic pump 8 are sprinkled over the whole of the objects 35, the objets 35 are uniformly cleaned.

Figure 15:
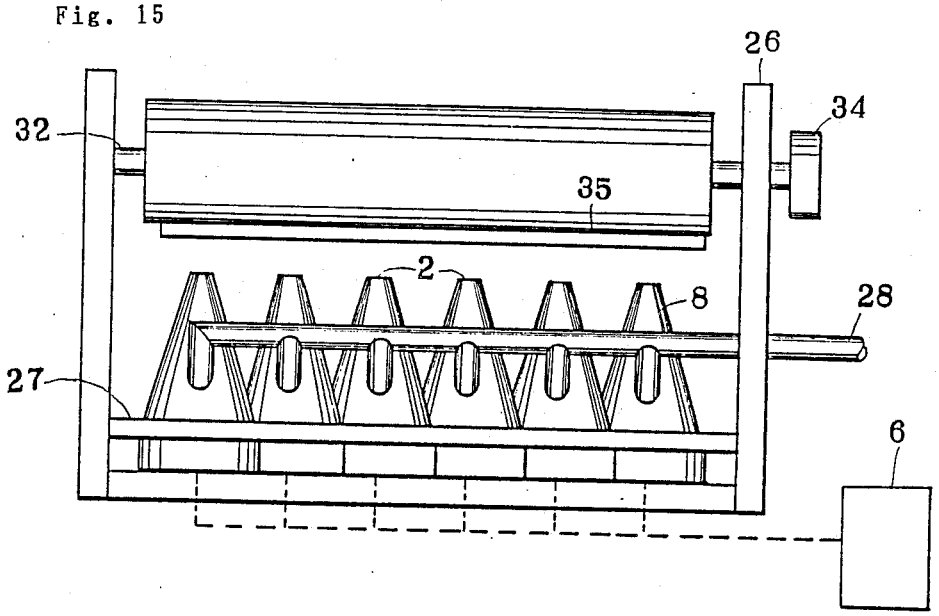
FIG. 15 is a front view of the still another ultrasonic cleaning device according to the present invention.
Figure 16:
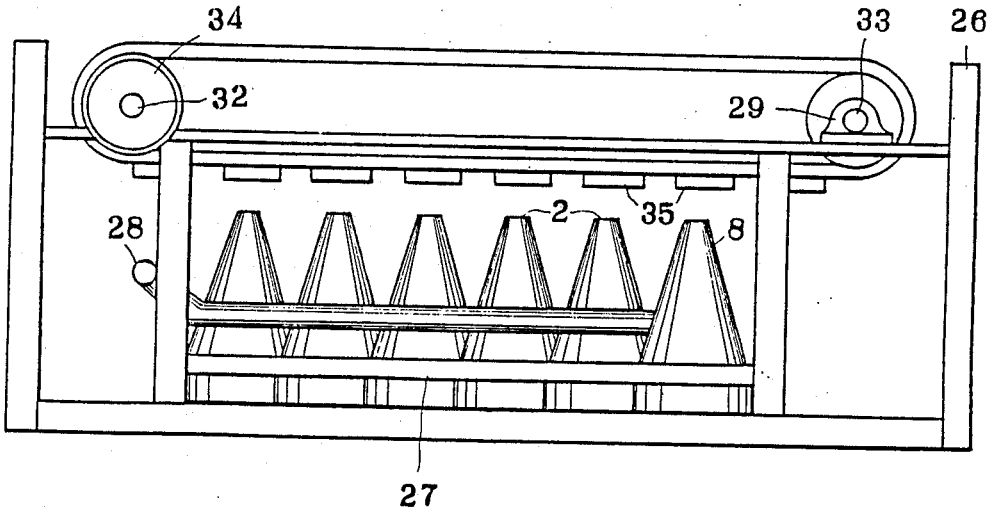
FIG. 16 is a side view of the ultrasonic cleaning device of FIG. 15.

Referring to FIGS. 15 and 16, another ultrasonic cleaning device according to the present invention substantially similar in physical construction to the device shown in FIGS. 11 and 12 except that the ultrasonic pumps 8 are arrayed by the supporting structure 27 at an oblique angle to the moving direction of the objects 35.

In the ultrasonic cleaning device according the present invention, since the interval to the moving direction between the neighboring spouting ports 2 becomes narrow, the liquid and the ultrasonic wave from the ultrasonic pump 8 are sprinkled over the whole of the objects 35 and the objects 35 are uniformly cleaned.

What is claimed is:

1. An ultrasonic cleaning device comprising:

an ultrasonic pump including a hollow cover, said hollow cover including a narrow portion forming a spouting port, a wide portion and a side portion between said narrow and wide portions, said side portion having an inside surface of a paraboloid and the focal point of said paraboloid is set to the outside of said spouting port;

an ultrasonic vibrator in the wide portion of the hollow cover;

a liquid supply port in the side portion of the hollow cover;

an oscillator connected to the ultrasonic vibrator;

wherein, a portion of the ultrasonic wave from the vibrator passes linearly from the vibrator through the spouting port and another portion of the ultrasonic wave is reflected from the side wall within the hollow cover and pases through the spouting port into contact with at least one object positioned in opposing relation to the spouting port.

2. An ultrasonic cleaning device as defined claim 1 wherein the oscillator intermittently generates pulses.

3. An ultrasonic cleaning device as defined claim 2 wherein the oscillator for intermittently generating comprises a first oscillator for generating pulses in short constant cycles and a second oscillator for generating pulses in long cycles, the output for supplying from the first oscillator to the ultrasonic vibrator being intermittently cut by the output from the second oscillator.

* * * * *